US012677964B1

(12) United States Patent
Luo

(10) Patent No.: US 12,677,964 B1
(45) Date of Patent: Jul. 14, 2026

(54) MULTIFUNCTIONAL BABY WALKER

(71) Applicant: Lifang Luo, Ganzhou (CN)

(72) Inventor: Lifang Luo, Ganzhou (CN)

( * ) Notice: Subject to any disclaimer, the term of this patent is extended or adjusted under 35 U.S.C. 154(b) by 0 days.

(21) Appl. No.: 19/369,791

(22) Filed: Oct. 27, 2025

(51) Int. Cl.
*A47D 13/04* (2006.01)
*A47D 13/10* (2006.01)
*A63H 5/00* (2006.01)

(52) U.S. Cl.
CPC ..... *A47D 13/043* (2013.01); *A47D 13/101* (2022.08); *A47D 13/102* (2013.01); *A63H 5/00* (2013.01)

(58) Field of Classification Search
CPC .. A47D 13/043; A47D 13/101; A47D 13/102; A47D 5/00; A63H 5/00
See application file for complete search history.

(56) References Cited

U.S. PATENT DOCUMENTS 140,900 A * 7/1873 Downing ..... A47D 1/06 297/131
146,889 A * 1/1874 Downing ..... A47D 13/043 297/151
529,359 A * 11/1894 Bradish ..... A47D 1/08 297/196
D401,894 S * 12/1998 Cheng ..... D21/412
5,845,963 A * 12/1998 Huang ..... A47D 13/043 482/68
5,938,218 A * 8/1999 Chuang ..... A47D 13/102 280/87.051
6,513,869 B1 * 2/2003 Wu ..... A47D 13/102 297/130
7,007,959 B1 * 3/2006 Lu ..... A47D 13/043 280/87.051
9,192,247 B1 * 11/2015 Lu ..... A47D 13/102
9,648,962 B1 * 5/2017 Cheng ..... A47D 13/043
2024/0227905 A1 * 7/2024 Luo ..... B62B 9/24

FOREIGN PATENT DOCUMENTS

CN 111887668 A * 11/2020 ..... A47D 15/00
GB 2340414 A * 2/2000 ..... A47D 13/105
KR 890002020 Y1 * 4/1989 ..... A47D 13/043
KR 200185382 Y1 * 6/2000 ..... A47D 13/04

* cited by examiner

*Primary Examiner* — Emma K Frick

(57) ABSTRACT

A multifunctional baby walker includes an upper plate assembly, a base frame assembly, and a support assembly configured for connecting the upper plate assembly and the base frame assembly. The base frame assembly includes a first transverse bar and a second transverse bar arranged opposite to the first transverse bar. A side support bar is arranged between the first transverse bar and the second transverse bar. An outer side wall of the side support bar is provided with an arc-shaped protruding surface, and a wheel assembly is arranged at a bottom portion of the side support bar. The side support bar is provided with a first operational state and a second operational state. The side support bar is capable of switching between these two operational states.

20 Claims, 15 Drawing Sheets

MULTIFUNCTIONAL BABY WALKER

TECHNICAL FIELD

The present disclosure relates to the field of baby walker, in particular to a multifunctional baby walker.

BACKGROUND

Baby walkers are common assisting devices for toddlers during their growth and development, primarily used to assist toddlers in learning to walk and to provide entertainment. Although some existing baby walkers integrate both mobility function and swinging function, these baby walkers typically feature complex structures. The transition between the above-mentioned functions often requires additional attachments or the disassembly of components, which leads to inconvenient switching and increases operational difficulty.

In view of the above question, the present disclosure provides a multifunctional baby walker. The baby walker is capable of switching quickly between a mobility mode and a swinging mode, so as to enhance its versatility and convenience.

SUMMARY

In order to overcome the shortcomings of existing technology, the present disclosure provides a multifunctional baby walker. The multifunctional baby walker is capable of quickly switching between a mobility mode and a swinging mode, so as to enhance its versatility and convenience.

The technical solution adopted by the present disclosure to solve the technical problems is as follows.

The multifunctional baby walker includes an upper plate assembly, a base frame assembly, and a support assembly configured for connecting the upper plate assembly and the base frame assembly. The base frame assembly includes a first transverse bar and a second transverse bar arranged opposite to the first transverse bar. A side support bar is arranged between the first transverse bar and the second transverse bar. An outer side wall of the side support bar is provided with an arc-shaped protruding surface, and a wheel assembly is arranged at a bottom portion of the side support bar. The side support bar is provided with a first operational state and a second operational state. The side support bar is capable of switching between the first operational state and the second operational state. When the side support bar switches to the first operational state, the protruding surface is disengaged from a ground, and the wheel assembly is configured for supporting the baby walker on the ground. When the side support bar switches to the second operational state, the protruding surface is in contact with the ground, and the wheel assembly is lifted away from the ground, so that the baby walker is capable of swinging back and forth.

In this disclosure, the side support bar is capable of switching between the first operational state and the second operational state. This achieves a free transition of the baby walker between a mobility mode and a swinging mode. In the mobility mode, the wheel assembly is in contact with the ground. This allows the baby walker to be pushed to move, thereby meeting toddlers' training needs for walking. In the swinging mode, the wheel assembly is lifted away from the ground, and the arc-shaped protruding surface is in contact with the ground, so that the baby walker is capable of swinging back and forth. This enhances entertainment value, user engagement, and functionality of the baby walker.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
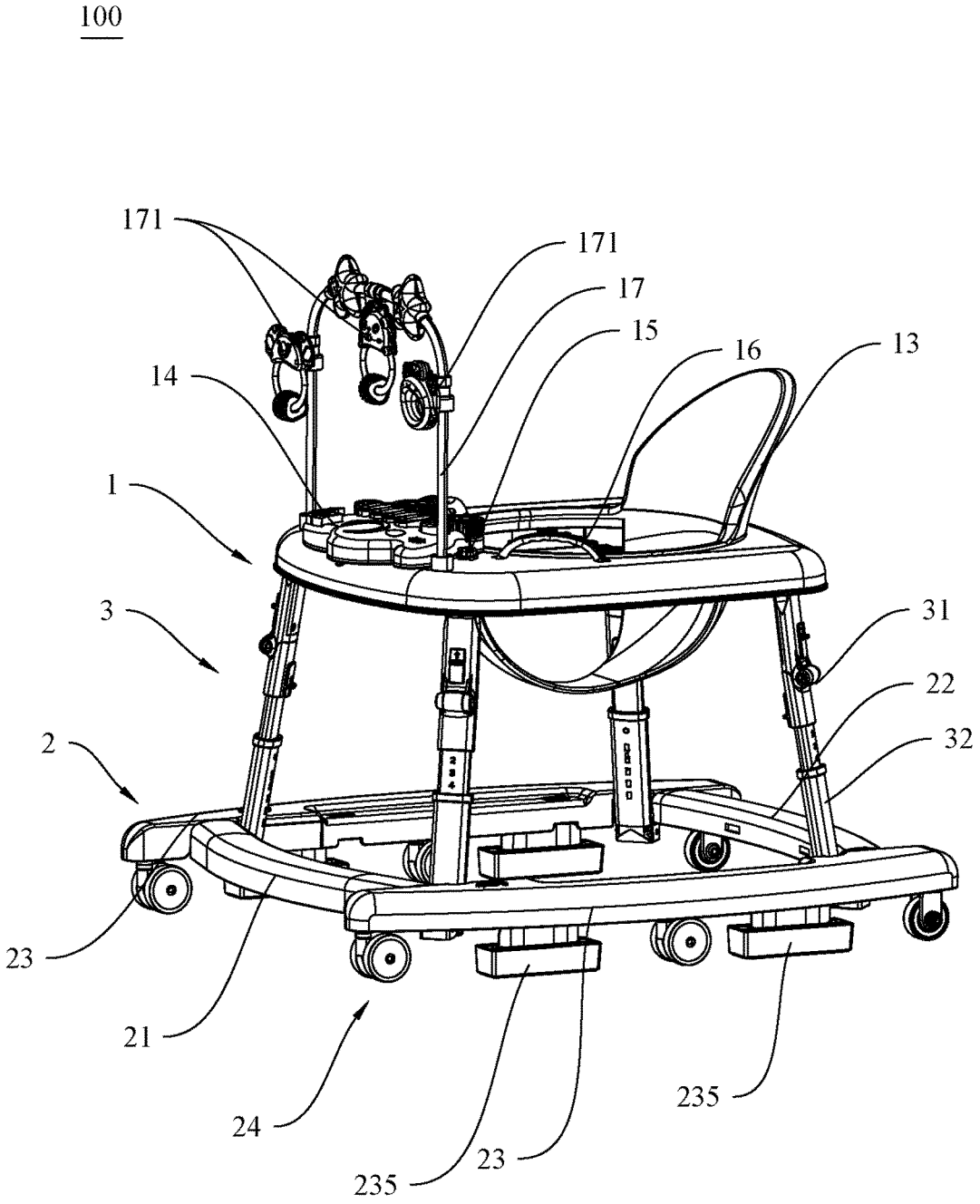
FIG. 1 is an overall structural diagram of a baby walker in a first operational state.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
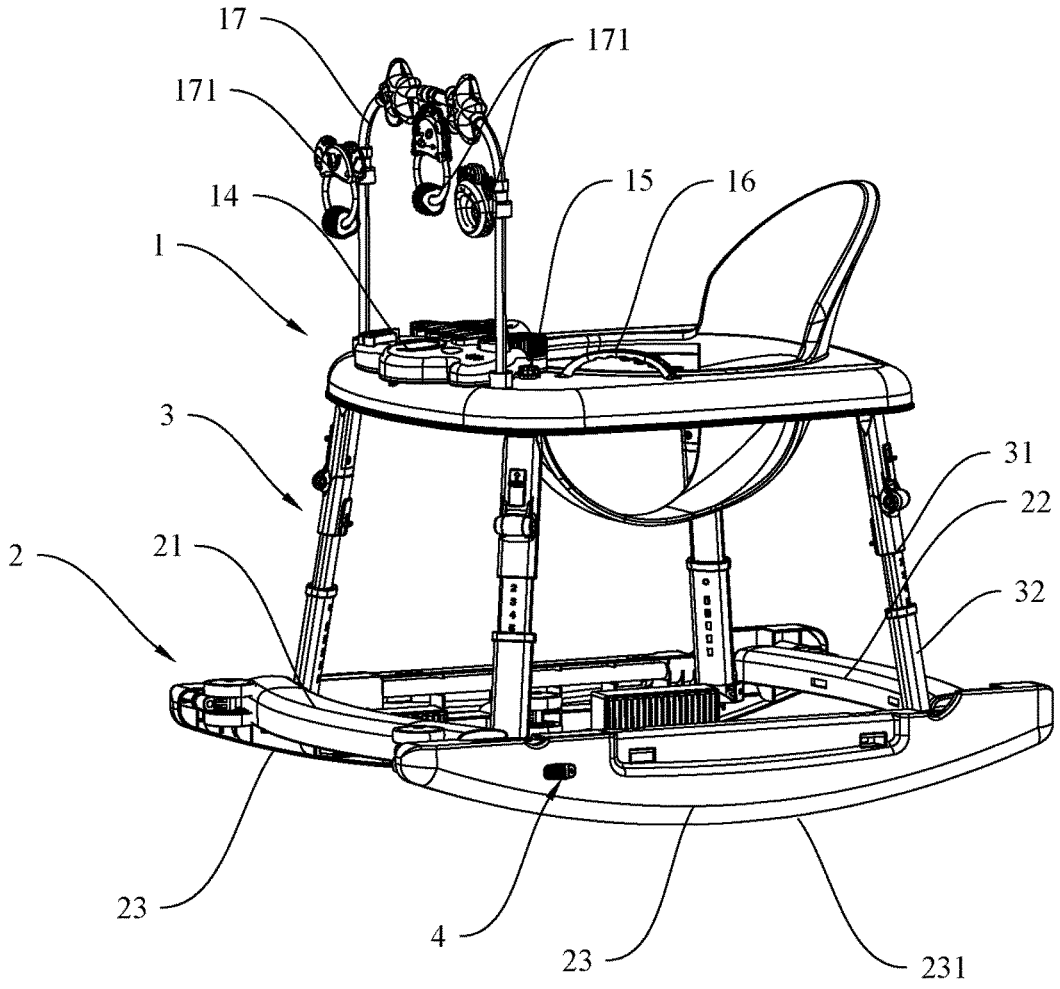
FIG. 2 is an overall structural diagram of the baby walker in a second operational state.

The present disclosure provides a multifunctional baby walker 100. Referring to FIG. 1 and FIG. 2, the multifunctional baby walker 100 includes an upper plate assembly 1, a base frame assembly 2, and a support assembly 3 configured for connecting the upper plate assembly 1 and the base frame assembly 2. The base frame assembly 2 includes a first transverse bar 21 and a second transverse bar 22 arranged opposite to the first transverse bar 21. A side support bar 23 is arranged between the first transverse bar 21 and the second transverse bar 22. An outer side wall of the side support bar 23 is provided with an arc-shaped protruding surface 231, and a wheel assembly 24 is arranged at a bottom portion of the side support bar 23. The side support bar 23 is provided with a first operational state and a second operational state. The side support bar 23 is capable of switching between the first operational state and the second operational state. When the side support bar 23 switches to the first operational state, the protruding surface 231 is disengaged from a supporting surface of the multifunctional baby walker 100 (e.g., the ground, the floor), and the wheel assembly 24 is configured for supporting the baby walker on the ground. When the side support bar 23 switches to the second operational state, the protruding surface 231 is in contact with the ground, and the wheel assembly 24 is lifted away from the ground, so that the baby walker is capable of swinging back and forth.

In this embodiment, the side support bar 23 is capable of switching between the first operational state and the second operational state. This achieves a free transition of the baby walker between a mobility mode and a swinging mode. In the mobility mode, the wheel assembly 24 is in contact with the ground. This allows the baby walker to be pushed to move, thereby meeting toddlers' training needs for walking. In the swinging mode, the wheel assembly 24 is lifted away from the ground, and the arc-shaped protruding surface 231 is in contact with the ground, so that the baby walker is capable of swinging back and forth. This enhances entertainment value, user engagement, and functionality of the baby walker.

Figure 3:
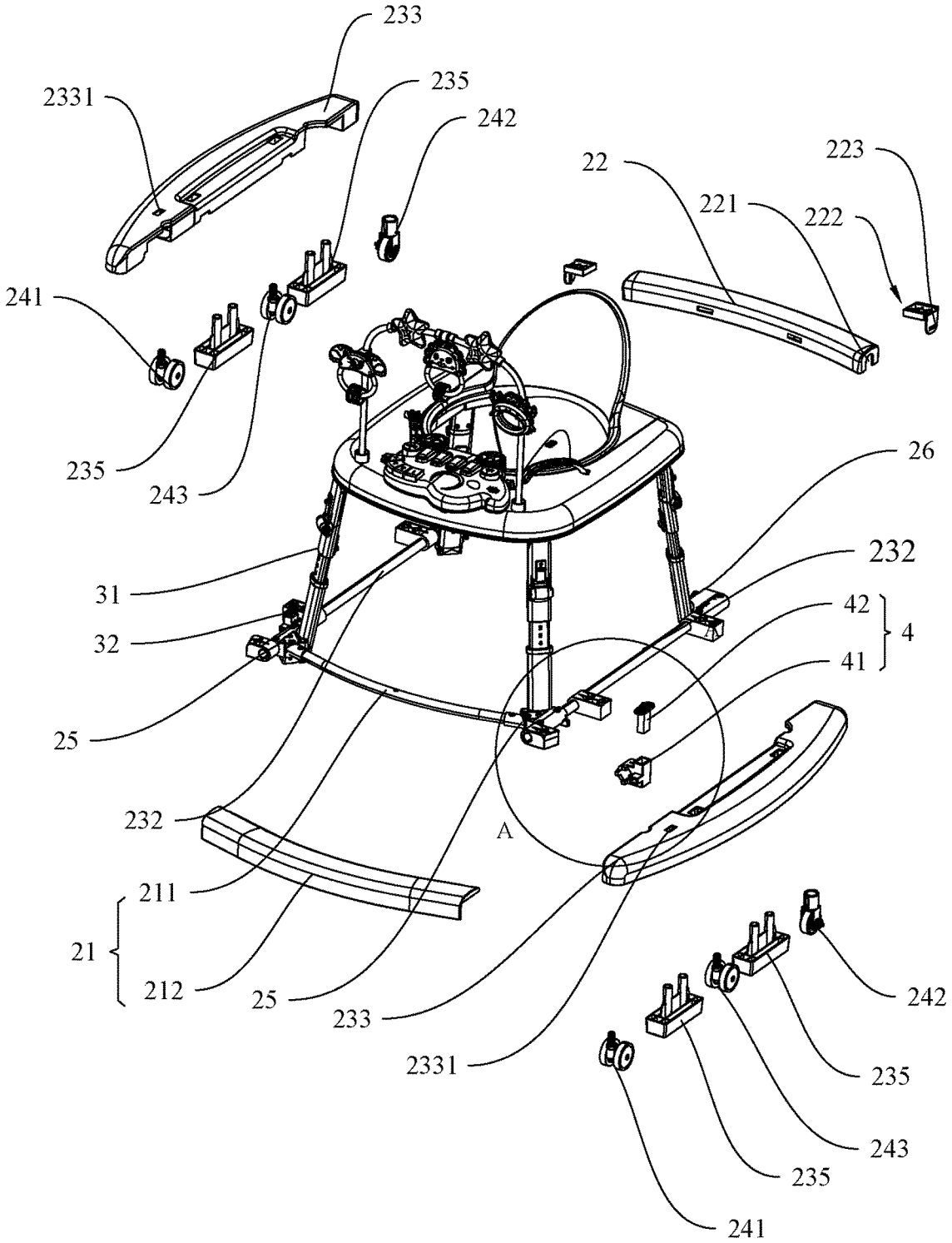
FIG. 3 is an exploded view of the baby walker.
Figure 4:
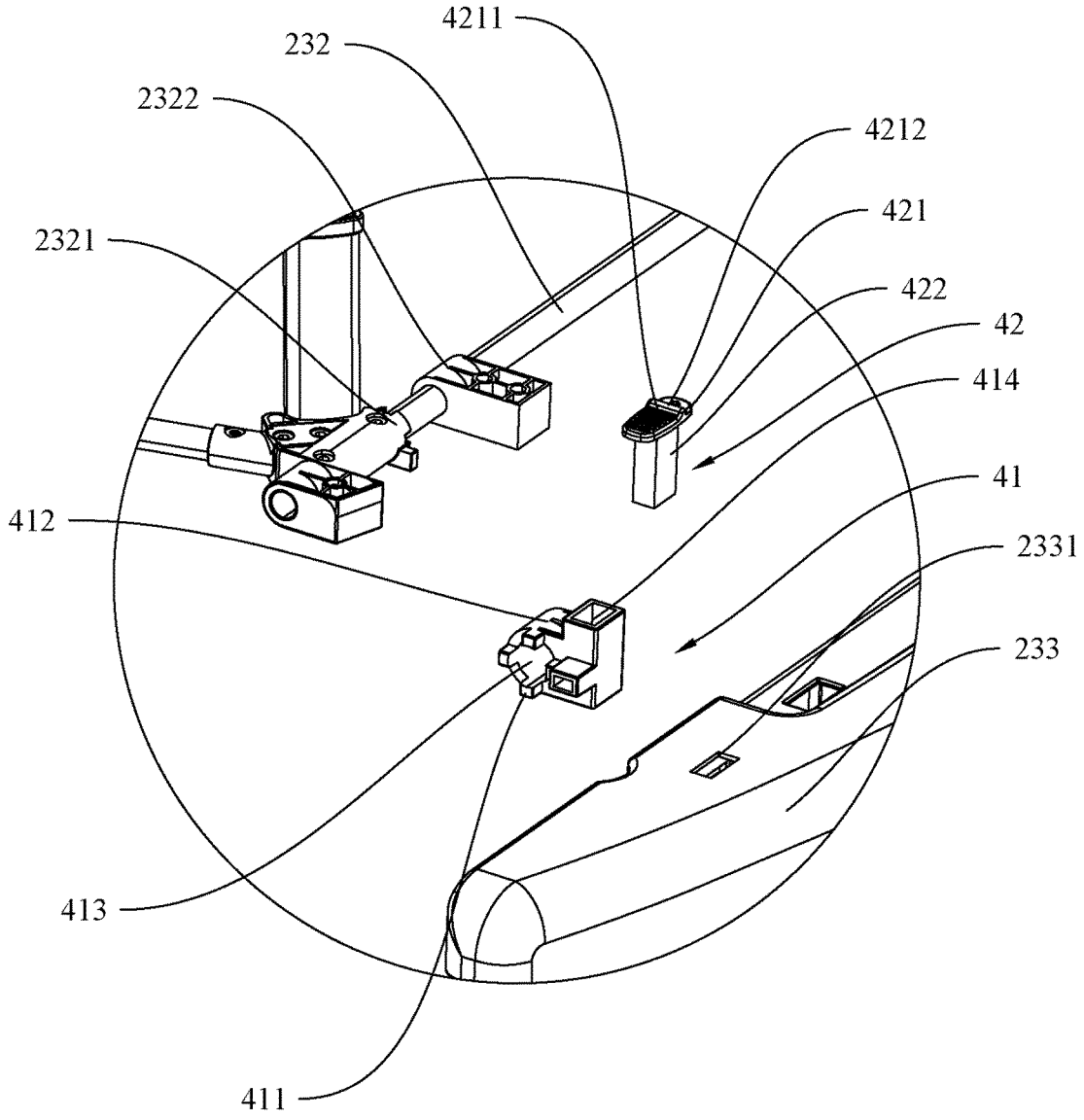
FIG. 4 is a partial enlarged structural diagram of area A in FIG. 3.
Figure 5:
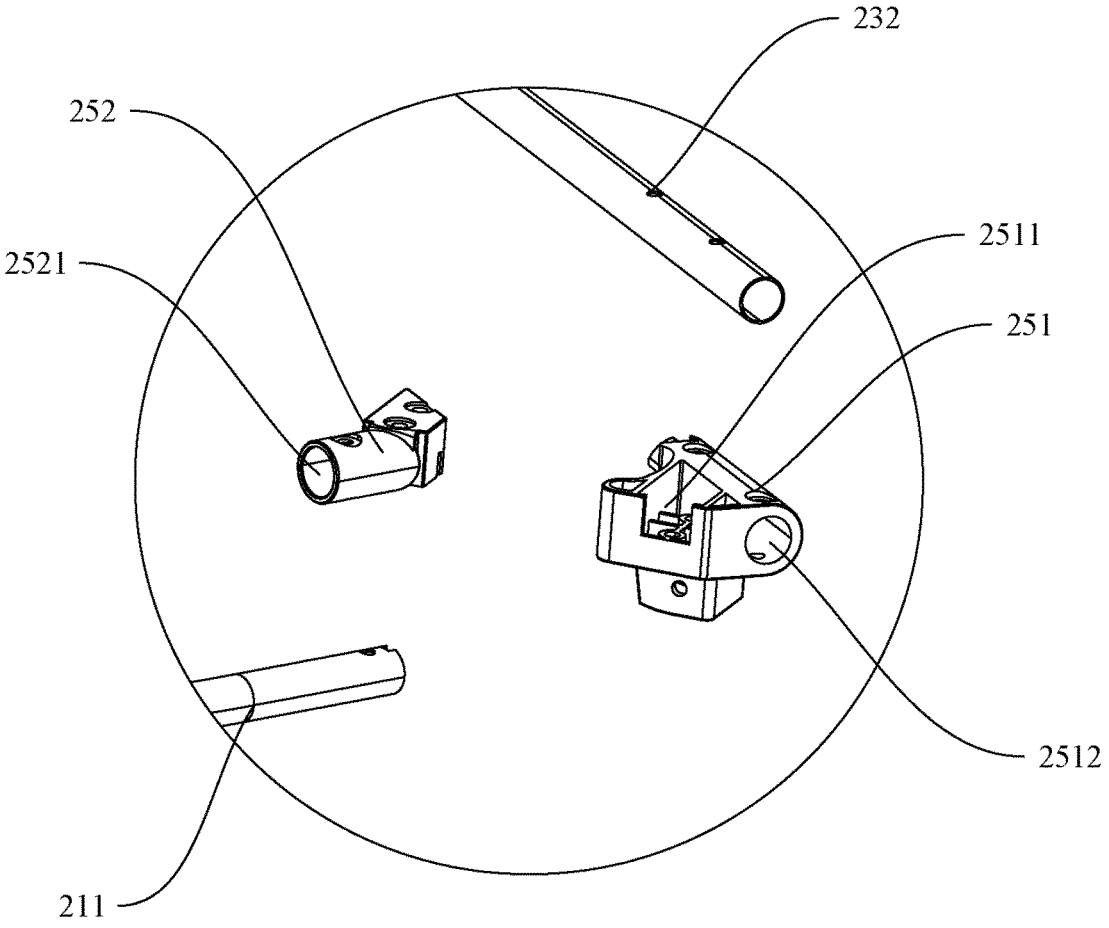
FIG. 5 is an exploded view showing the connection between a first inner rod and a second inner rod.
Figure 6:
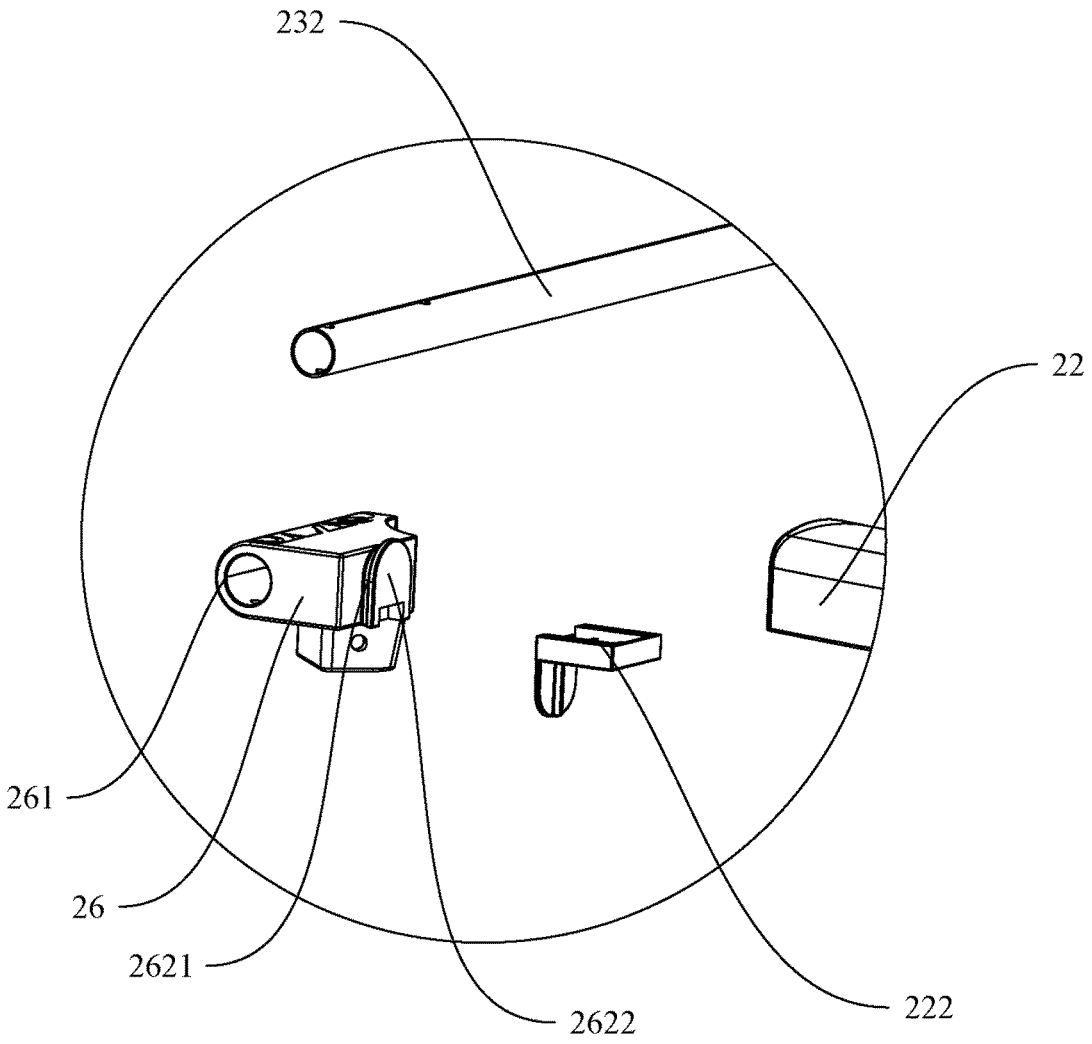
FIG. 6 is an exploded view showing the connection between the first inner rod and a second transverse bar.
Figure 7:
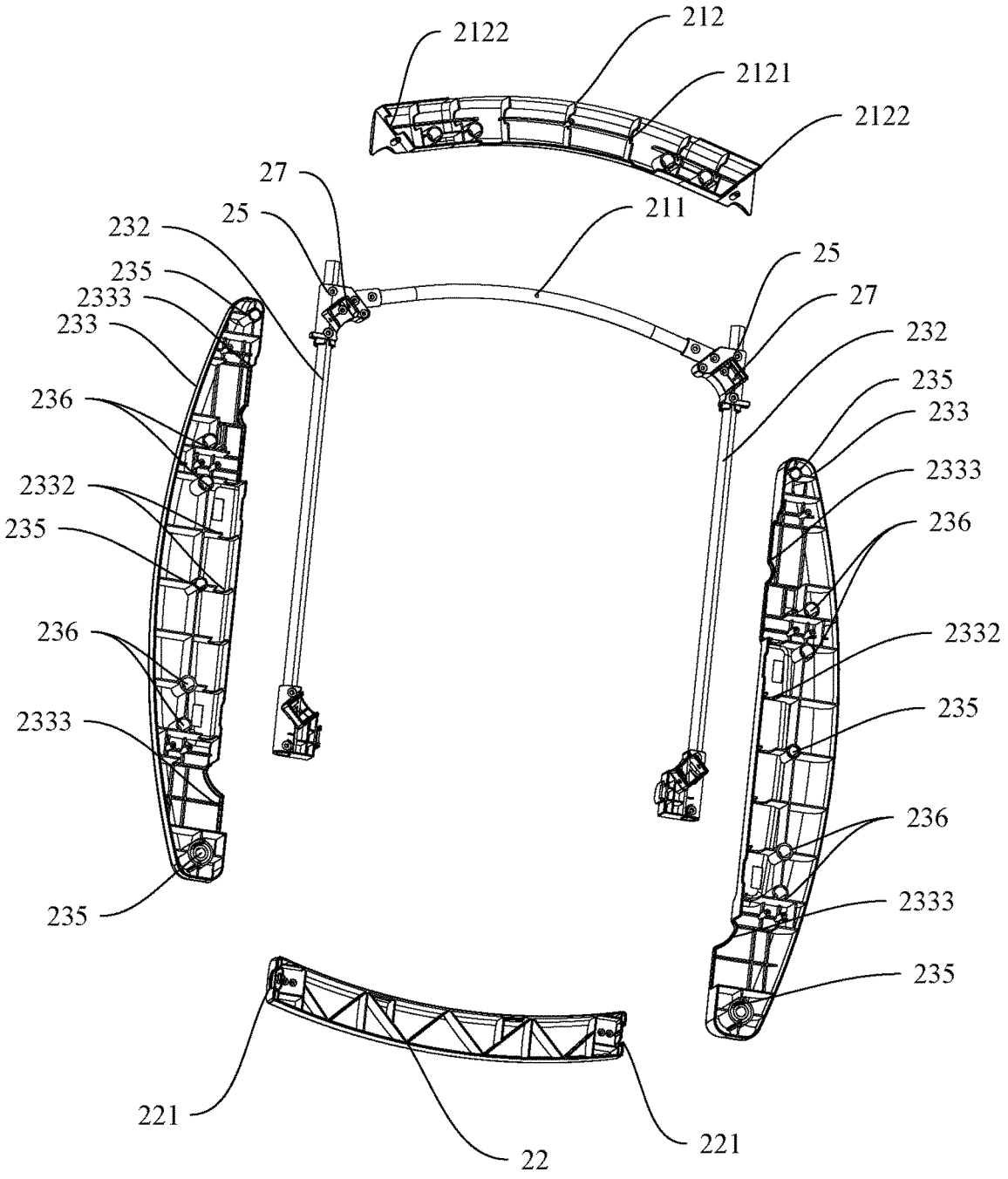
FIG. 7 is a structural diagram of a bottom portion of a base frame assembly.
Figure 8:
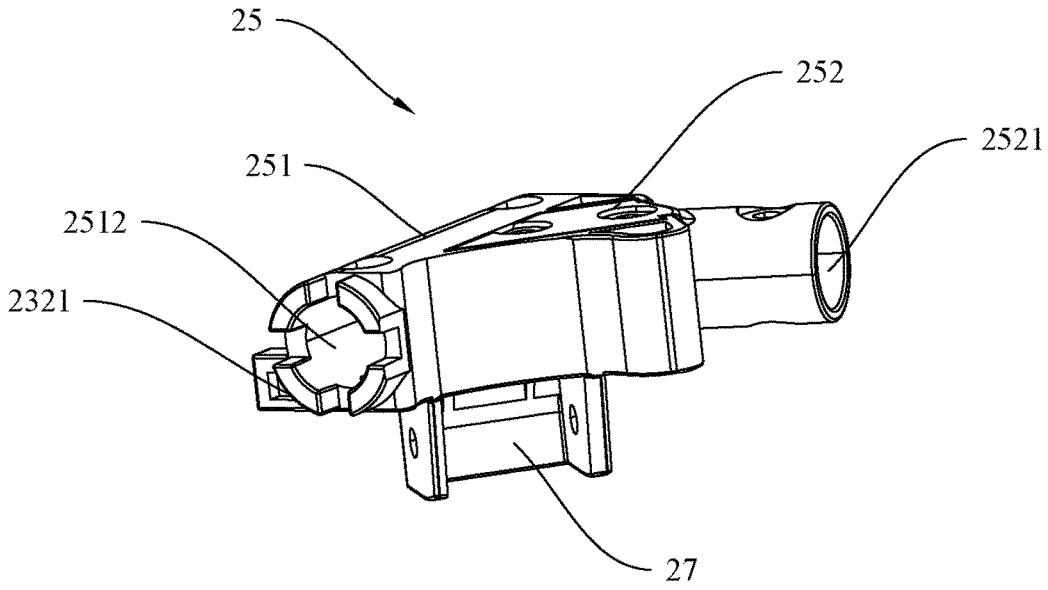
FIG. 8 is a structural diagram of a first connecting member.
Figure 9:
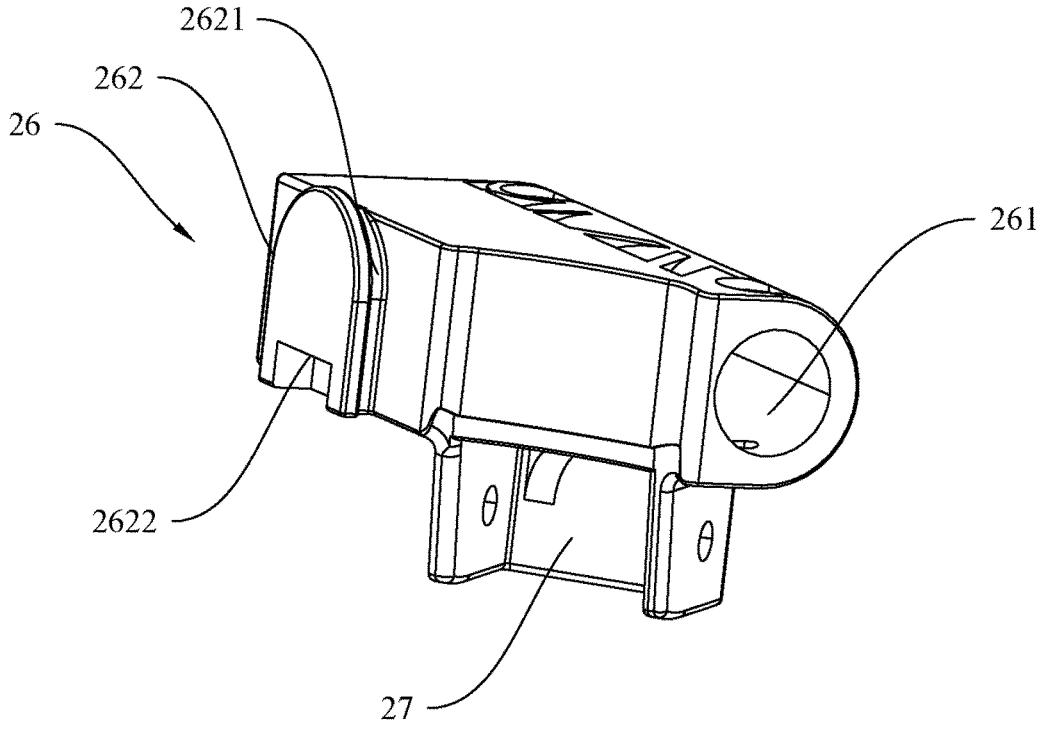
FIG. 9 is a structural diagram of a second connecting member.
Figure 10:
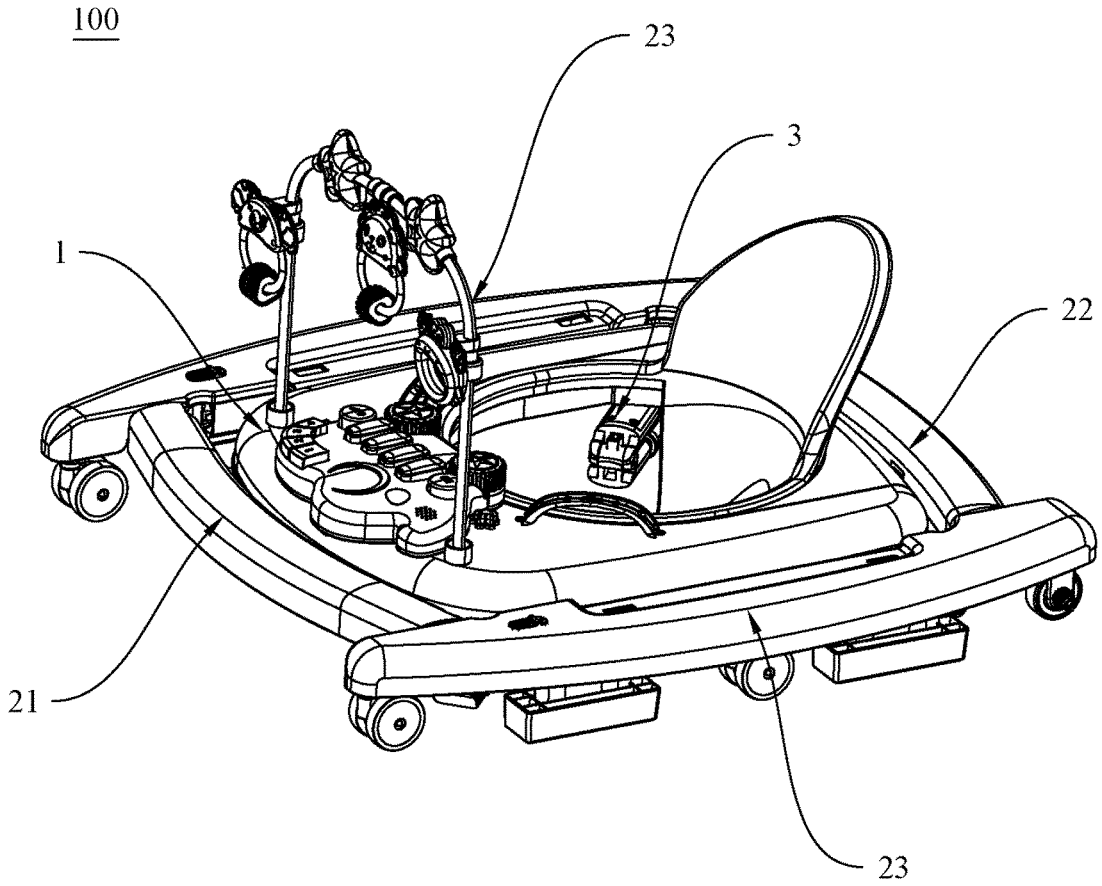
FIG. 10 is a structural diagram showing a folded state of the baby walker.
Figure 11:
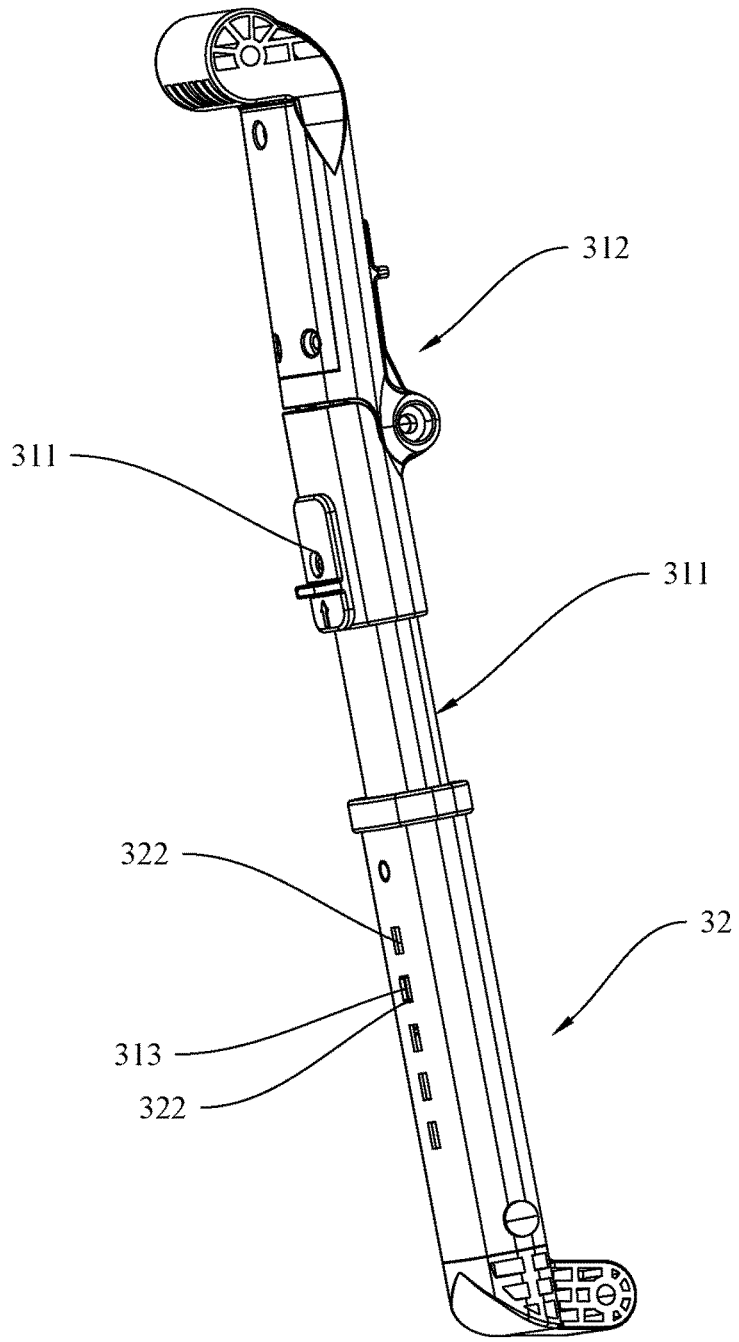
FIG. 11 is a structural diagram of a support assembly.
Figure 12:
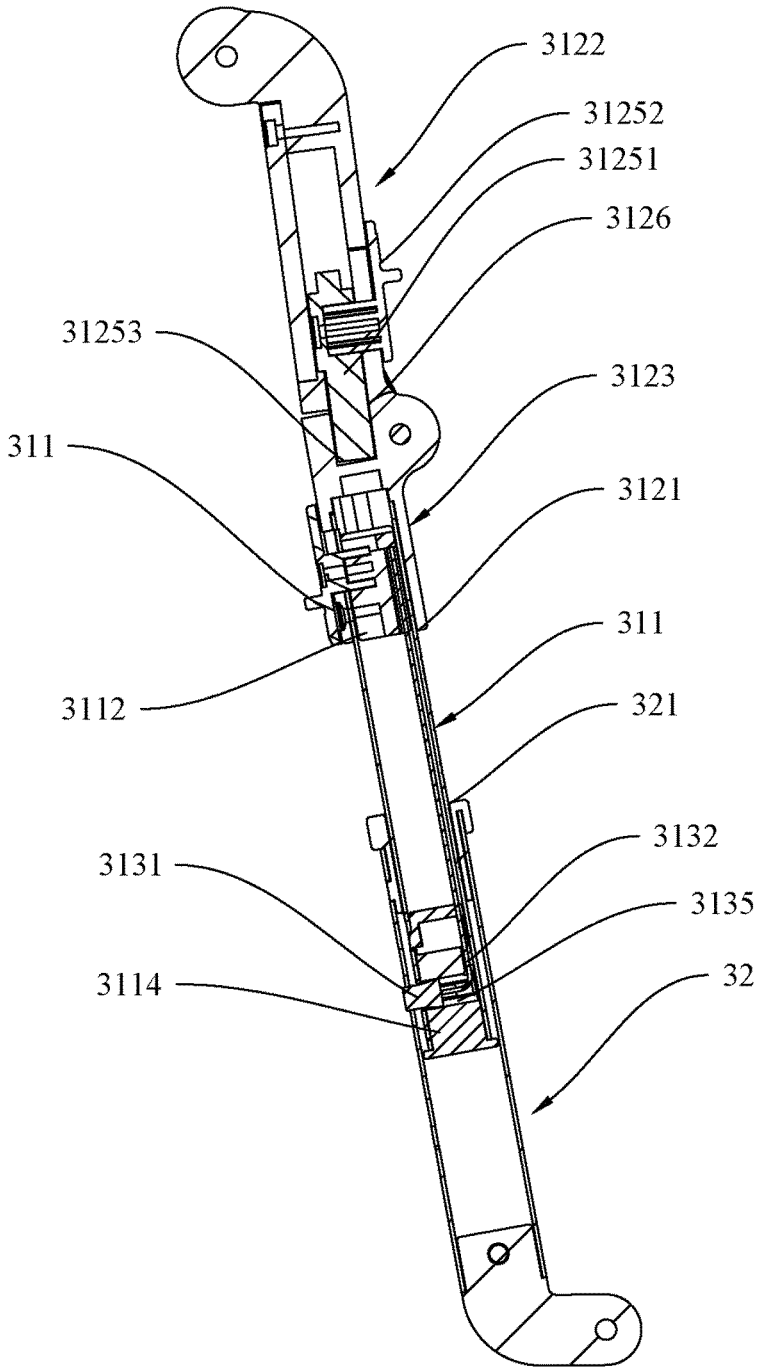
FIG. 12 is a sectional view of the support assembly.
Figure 13:
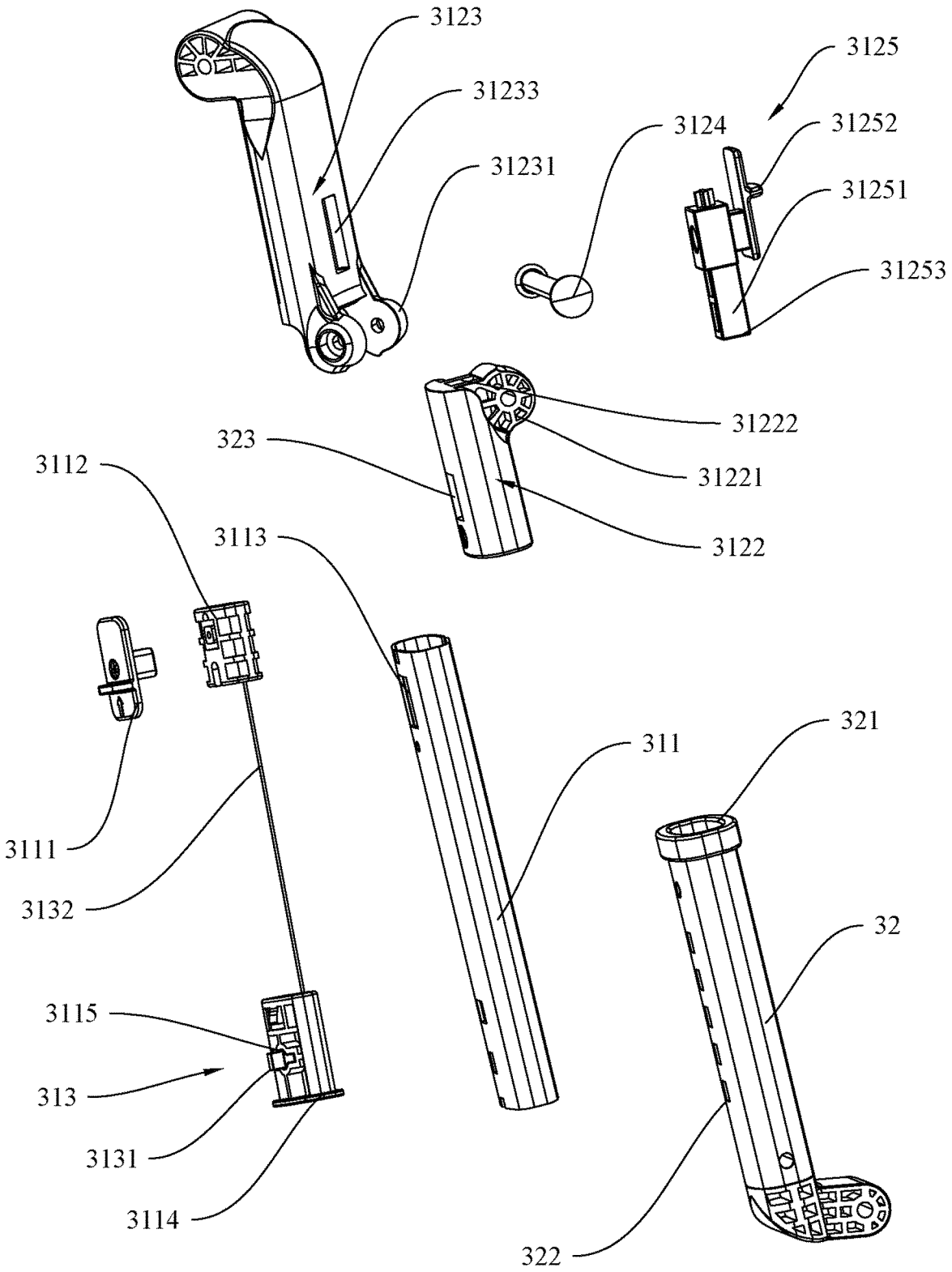
FIG. 13 is an exploded view of the support assembly.
Figure 14:
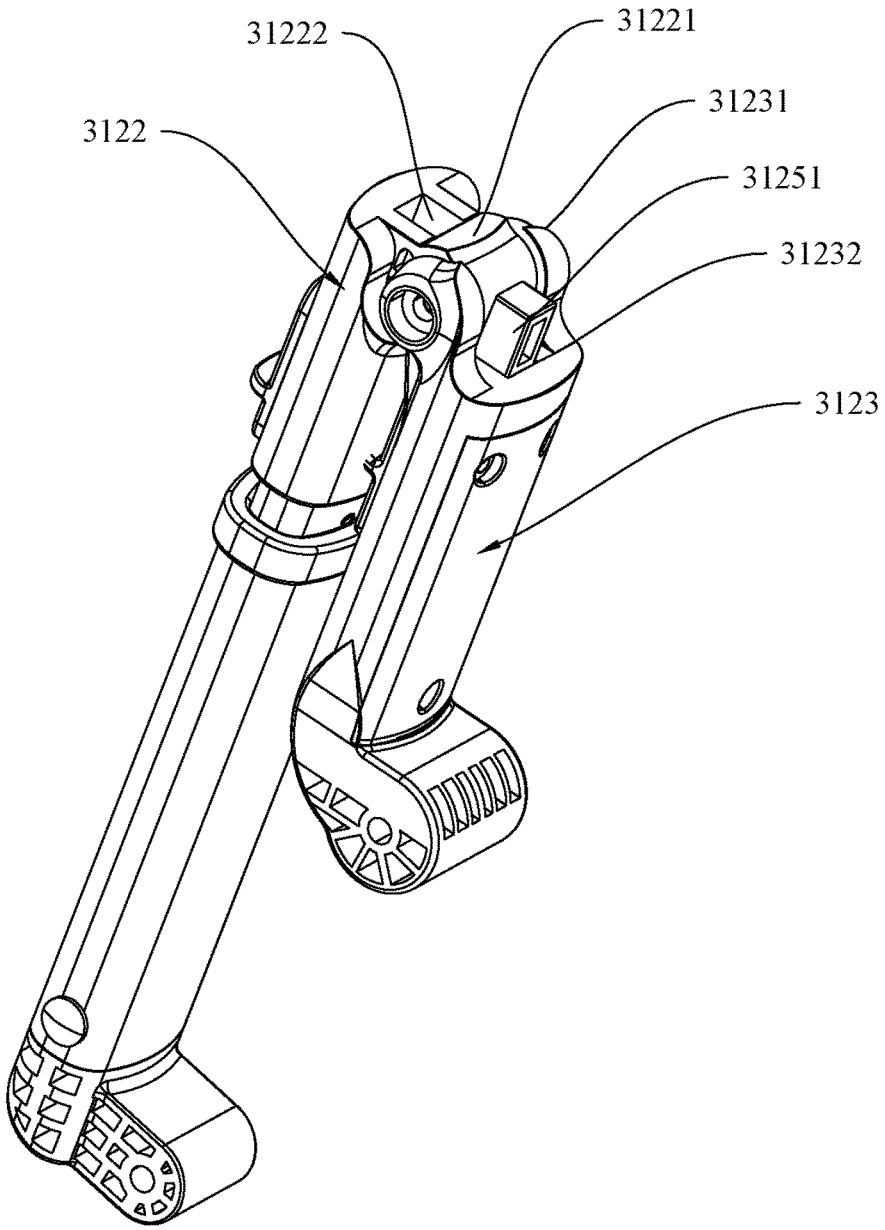
FIG. 14 is a structural diagram showing a folded state of a telescoping sleeve.

In this embodiment, referring to FIG. 3 and FIG. 4, the side support bar 23 includes a first inner rod 232 and a first outer bar 233 mounted on the first inner rod 232. The protruding surface 231 is arranged on an outer side wall of the first outer bar 233, and the wheel assembly 24 is arranged at a bottom portion of the first outer bar 233. The first outer bar 233 is capable of rotating around the first inner rod 232, so that the side support bar 23 is capable of switching between the first operational state and the second operational state. In this way, the first outer bar 233 is capable of rotating around the first inner rod 232, so that the side support bar 23 is enabled to switch rapidly between the first operational state (mobility mode) and the second operational state (swinging mode). This features simple operation, which enhances user convenience.

In this embodiment, the base frame assembly 2 further includes a first locking member 4 arranged on the side support bar 23. The first locking member 4 is provided with a locked state and an unlocked state. When the first locking member 4 is in the locked state, the first locking member 4 is configured for locking the side support bar 23 in either the first operational state or the second operational state. When the first locking member 4 is in the unlocked state, the first locking member 4 is released to disengage the lock on the side support bar 23, so that the side support bar is capable of switching between the first operational state and the second operational state. By arranging the first locking member 4, the side support bar 23 can be securely locked after being switched to a required operational state. This prevents the baby walker from toppling over or slipping during use due to accidental shaking or looseness, thereby ensuring safety of toddlers.

In this embodiment, a first locking portion 2321 is arranged on the side support bar 23. The first locking member 4 is slidably arranged on the side support bar 23. The first locking member 4 is provided with a first locking engagement portion 411 corresponding to the first locking portion 2321. When the first locking member 4 slides to a position where the first locking engagement portion 411 is connected to the first locking portion 2321, the first locking member 4 is in the locked state. In addition, the first locking member 4 is configured for locking the side support bar 23 in either the first operational state or the second operational state. When the first locking member 4 slides to a position where the first locking engagement portion 411 is disconnected from the first locking portion 2321, the first locking member 4 is in the unlocked state. In addition, the first outer bar 233 is capable of rotating around the first inner rod 232, so that the first outer bar 233 is capable of switching between the first operational state and the second operational state. By arranging a slidable first locking member 4 and a slidable first locking engagement portion 411 on the side support bar 23, the side support bar 23 can be securely locked and can switch conveniently between different operational states. This not only enhances operational simplicity and structural durability, but also further improves the safety and practicality of the baby walker.

In this embodiment, the first locking member 4 includes a first locking block 41 and a first pushing block 42 connected to the first locking block 41. The first locking block 41 is slidably arranged on the first inner rod 232. The first locking portion 2321 is arranged on the first inner rod 232. The first locking engagement portion 411 is arranged on the first locking block 41. The first pushing block 42 is configured for pushing the first locking block 41 to slide on the first inner rod 232, so that the first locking portion 2321 is connected to or disconnected from the first locking engagement portion 411. By arranging the first pushing block 42, users only need to push the first pushing block 42 to drive the first locking block 41 to slide on the first inner rod 232, so as to complete the locking or unlocking operation. This method of use is intuitive and simple, which improves the convenience of operation.

In this embodiment, the first locking block 41 is provided with a sleeve portion 412, and a receiving hole 413 is defined in the sleeve portion 412. The first inner rod 232 is inserted into the receiving hole 413, so that the first locking block 41 is slidably arranged on the first inner rod 232. By arranging the sleeve portion 412 and the receiving hole 413 on the first locking block 41, the first locking block 41 is enabled to form a stable sliding engagement with the first inner rod 232. This improves smoothness of operation and durability of the first locking member 4.

In this embodiment, a connecting slot 414 is defined in the first locking block 41. The first pushing block 42 includes a pushing portion 421 and a connecting post 422. The connecting post 422 is mounted inside the connecting slot 414, so that the first pushing block 42 is connected to the first locking block 41. Through the above structure, a stable connection structure is formed between the first locking block 41 and the first pushing block 42, thereby avoiding looseness or detachment between the first pushing block 42 and the first locking block 41.

In this embodiment, a first mounting opening 2331 is defined in the first outer bar 233. The connecting post 422 is inserted into the first mounting opening 2331 and extends inwards to connect to the connecting slot 414. The pushing portion 421 is arranged facing an outer side of the first mounting opening 2331, so as to enable users to complete locking or unlocking operation rapidly. A pushing protrusion 4211 and an anti-slip texture 4212 are arranged on a surface of the pushing portion 421. By arranging the pushing protrusion 4211 and the anti-slip texture 4212 on the surface of the pushing portion 421, the friction is thereby effectively increased. This allows users to push the baby walker easily even when their hands are wet or the hand strength is limited, thereby enhancing operational reliability.

In this embodiment, a limiting block 2322 is arranged on the first inner rod 232. The limiting block 2322 abuts against the first locking block 41, so as to limit a moving distance of the first locking block 41. This avoids detachment or misalignment of the first locking block 41 due to excessive moving distance, thereby ensuring the reliability of the first locking member 4.

In this embodiment, referring to FIG. 3, and FIG. 5 to FIG. 9, two side support bars 23 are arranged between the first transverse bar 21 and the second transverse bar 22, and the two side support bars 23 are arranged opposite to each other. First ends of the two side support bars 23 are connected to both ends of the first transverse bar 21 via first connecting members 25. Second ends of the two side support bars 23 are detachably connected to both ends of the second transverse bar 22 via second connecting members 26. Through the above structure, the base frame assembly 2 has a stable and reliable frame structure, thereby enhancing the overall strength and load-bearing capacity of the base frame assembly 2.

Specifically, the first connecting member 25 includes a first connecting block 251 and a second connecting block 252 connected to the first connecting block 251. The side support bar 23 is connected to the first connecting block 251, and the first transverse bar 21 is connected to the second connecting block 252, so that the side support bar 23 is connected to the first transverse bar 21. A mounting recess 2511 is defined in the first connecting block 251. In addition, the second connecting block 252 is arranged in the mounting recess 2511, so that the first connecting block 251 is connected to the second connecting block 252. Through the above structure, the first connecting member 25 has a stable and reliable structure, so that the connection between the side support bar 23 and the first transverse bar 21 is firm and reliable. Therefore, this structure is not easy to get loose.

In this embodiment, a first mounting channel 2512 is arranged on the first connecting block 251, and a second mounting channel 2521 is arranged on the second connecting block 252. The first transverse bar 21 includes a second inner rod 211 and a second outer bar 212 mounted on the second inner rod 211. The first inner rod 232 of the side support bar 23 is inserted into the first mounting channel 2512, and the second inner rod 211 is inserted into the second mounting channel 2521. Through the above structure, a reliable connection is established between the first inner rod 232 of the side support bar 23 and the second inner rod 211 of the first transverse bar 21, thereby enhancing the stability of the overall structure.

In this embodiment, the first outer bar 233 of the side support bar 23 is engaged with the first connecting block 251. The second outer bar 212 is engaged with the second connecting block 252, so that the side support bar 23 is connected to the first transverse bar 21. Specifically, a plurality of first mounting notches 2332 are arranged on an inner side wall of the first outer bar 233 of the side support bar 23. The first inner rod 232 is engaged in the first mounting notch 2332, so that the first outer bar 233 is connected to the first inner rod 232. A plurality of second mounting notches 2121 are arranged on an inner side wall of the second outer bar 212. The second inner rod 211 is engaged in the second mounting notch 2121, so that the second outer bar 212 is connected to the second inner rod 211. Both end portions of the first outer bar 233 are provided with first engagement interfaces 2333. The first engagement interface 2333 is engaged with the first connecting block 251. Both end portions of the second outer bar 212 are provided with second engagement interfaces 2122. The second engagement interface 2122 is engaged with the second connecting block 252. Through the above structure, a stable and reliable connection is established between the second outer bar 212 and the first outer bar 233 of the side support bar 23, so as to enhance the stability between the side support bar 23 and the first transverse bar 21, thereby avoiding looseness or detachment.

Preferably, the first locking portion 2321 is arranged on an end portion of the first mounting channel 2512. The first locking portion 2321 includes a plurality of recesses circumferentially arranged around the end portion of the first mounting channel 2512. The first locking engagement portion 411 includes a plurality of protrusions circumferentially arranged around an end portion of the sleeve portion 412. The protrusion is configured for engaging with the recess, so that the first locking portion 2321 is connected to or disconnected from the first locking engagement portion 411. Through the above structure, the first locking member 4 is enabled to achieve a stable locking effect, so as to avoid looseness of the side support bar 23 during use. Moreover, the first locking member 4 is enabled to quickly switch between the locked state and the unlocked state.

In this embodiment, a third mounting channel 261 is arranged on a first end of the second connecting member 26, and a second end of the side support bar 23 is inserted into the third mounting channel 261. A first engagement block 262 is arranged on a side wall of a second end of the second connecting member 26. A first engagement slot 2621 is defined in the first engagement block 262. Both end portions of the second transverse bar 22 are respectively provided with third mounting notches 221. The third mounting notch 221 is engaged in the first engagement slot 2621, so that the side support bar 23 is detachably connected to the second transverse bar 22. By arranging the third mounting channel 261 on the first end of the second connecting member 26, the side support bar 23 can be inserted into the third mounting channel 261. In addition, the side support bar 23 is engaged with the third mounting notch 221 on the end portion of the second transverse bar 22 via the first engagement block 262. Therefore, this realizes a detachable connection between the side support bar 23 and the second transverse bar 22, so as to make the baby walker easy to be assembled, disassembled, and stored.

In this embodiment, referring to FIG. 3, both end portions of the second transverse bar 22 are provided with second engagement blocks 222. A limiting protrusion 223 is arranged at a bottom portion of a side wall of the second engagement block 222. A limiting plate 2622 is arranged on a side wall of the first engagement block 262. The limiting protrusion 223 abuts against the limiting plate 2622, so that the second transverse bar 22 and the side support bar 23 are limited and mounted together. In this way, this can effectively prevent the displacement or accidental detachment of the second transverse bar 22 and the side support bar 23 during use, thereby improving the safety of the baby walker.

In this embodiment, referring to FIG. 10-FIG. 15, a first end of the support assembly 3 is connected to the upper plate assembly 1, and a second end of the support assembly 3 is connected to the base frame assembly 2. A length of the support assembly 3 is adjustable between a retracted state and an extended state, so as to adjust a distance between the upper plate assembly 1 and the base frame assembly 2. The length of the support assembly 3 is adjustable between the retracted state and the extended state, allowing for flexible changes in the distance between the upper plate assembly 1 and the base frame assembly 2. In this way, this can adapt to needs of infants and toddlers of varying heights or at different growth stages.

Specifically, the support assembly 3 includes a telescoping assembly 31 and a first linking rod 32. A first end of the telescoping assembly 31 is connected to the upper plate assembly 1, and a second end of the telescoping assembly 31 is connected to a first end of the first linking rod 32. A second end of the first linking rod 32 is connected to the base frame assembly 2. A first connecting portion 27 is arranged on the base frame assembly 2, and a second connecting portion 11 is arranged at a bottom portion of the upper plate assembly 1. A bottom end of the first linking rod 32 is connected within the first connecting portion 27. The first end of the telescoping assembly 31 is connected within the second connecting portion 11. Preferably, the first connecting portions 27 are arranged on bottom ends of both the first connecting member 25 and the second connecting member 26. By inserting the bottom end of the first linking rod 32 into the first connecting portion 27 of the base frame assembly 2, and inserting the first end of the telescoping assembly 31 into the second connecting portion 11 of the upper plate assembly 1, a stable and reliable connection is thereby formed. At the same time, this also makes the assembly and disassembly process of the baby walker simple and fast, which facilitates transportation and storage.

In this embodiment, the telescoping assembly 31 includes a telescoping rod 311, a telescoping sleeve 312, and a first locking spring clip 313. A first opening 3121 is defined in the telescoping sleeve 312. A first end of the telescoping rod 311 is inserted into the telescoping sleeve 312 via the first opening 3121. A second opening 321 is defined in the first linking rod 32. A second end of the telescoping rod 311 is inserted into the first linking rod 32 via the second opening 321. The telescoping rod 311 is slidable inside the first linking rod 32, so as to adjust the length of the support assembly 3. The sliding engagement between the telescoping rod 311 and the first linking rod 32 enables flexible length adjustment of the support assembly 3. In this way, this can adjust the distance between the upper plate assembly 1 and the base frame assembly 2, so as to adapt to needs of infants and toddlers of varying heights or at different growth stages.

Specifically, a plurality of first adjusting holes 322 are defined in a side wall of the first linking rod 32. The first locking spring clip 313 is arranged on the telescoping rod 311. When the first locking spring clip 313 slides along with the telescoping rod 311 to the first adjusting hole 322, the first locking spring clip 313 extends out from the first adjusting hole 322. In addition, the first locking spring clip 313 is configured for locking the telescoping rod 311 on the telescoping sleeve 312, so as to fix the length of the support assembly 3. Through the cooperation between the first locking spring clip 313 on the telescoping rod 311 and the plurality of first adjusting holes 322 on the first linking rod 32, precise positioning and reliable locking can be achieved at different height positions. Therefore, this prevents the support assembly 3 from shaking or sliding due to looseness during use.

In this embodiment, the telescoping rod 311 is further provided with an operation block 3111 configured for pulling the telescoping rod 311 to slide within the first linking rod 32. A first mounting block 3112 is arranged inside a top end of the telescoping rod 311. A second mounting opening 323 is defined in a side wall of a top end of the telescoping sleeve 312. A third mounting opening 3113 is defined in a side wall of the top end of the telescoping rod 311. The operation block 3111 is inserted into the third mounting opening 3113 and the second mounting opening 323 in sequence. The operation block 3111 extends into an inner portion of the telescoping rod 311 to connect to the first mounting block 3112. Further, the operation block 3111 is pushed to drive the first mounting block 3112 to move, so as to drive the telescoping rod 311 to slide within the first linking rod 32. By arranging the operation block 3111 on the telescoping rod 311, users can simply push the operation block 3111 to drive the first mounting block 3112 to move, thereby driving the telescoping rod 311 to slide within the first linking rod 32. This makes the adjustment process simpler, quicker, and more intuitive.

In this embodiment, a second mounting block 3114 is arranged inside a bottom end of the telescoping rod 311. A through hole 3115 is defined in the second mounting block 3114. The first locking spring clip 313 includes a first latch 3131 and an elastic linking rod 3132. The first latch 3131 is arranged in the through hole 3115, and the first latch 3131 is connected to the first mounting block 3112 via the elastic linking rod 3132. When the operation block 3111 is pushed to move, the first latch 3131 is configured for sliding along with the telescoping rod 311. In addition, the first latch 3131 is configured for moving inside the telescoping rod 311 and pressing the elastic linking rod 3132. When the first locking spring clip 313 slides to the first adjusting hole 322, the elastic linking rod 3132 is configured for pushing the first latch 3131 to extend out from the first adjusting hole 322. The first latch 3131 is connected to the first mounting block 3112 via the elastic linking rod 3132. When the telescoping rod 311 slides to the first adjusting hole 322, the elastic linking rod 3132 is configured for automatically pushing the first latch 3131 to extend out, so as to achieve automatic locking. This ensures that the support assembly 3 is enabled to realize stable and fast positioning at the target length.

In this embodiment, the telescoping sleeve 312 includes a first sleeve 3122 and a second sleeve 3123. The first sleeve 3122 is connected to the telescoping rod 311. In addition, the first sleeve 3122 is rotatably connected to the second sleeve 3123, so that the telescoping sleeve 312 is provided with a folded state and an unfolded state. Specifically, a first rotating portion 31221 is arranged on the first sleeve 3122, and a second rotating portion 31231 is arranged on the second sleeve 3123. The first rotating portion 31221 is rotatably connected to the second rotating portion 31231 via a rotating shaft 3124. Through the above structure, the support assembly 3 can be expanded when in use and folded when not in use, thereby making it easy for users to store and carry, and improving the portability of the product.

In this embodiment, the telescoping sleeve 312 further includes a second locking member 3125 arranged on the second sleeve 3123. The second locking member 3125 is provided with a locked state and an unlocked state. When the second locking member 3125 is in the locked state, the second locking member 3125 is configured for locking the telescoping sleeve 312 in the unfolded state. When the second locking member 3125 is in the unlocked state, the telescoping sleeve 312 is capable of switching between the unfolded state and the folded state. By arranging the second locking member 3125, the telescoping sleeve 312 can be locked and fixed in the unfolded state or the folded state. Therefore, this prevents the baby walker from malfunctioning during storage or use, thereby ensuring the safety of infants and toddlers.

Specifically, the second locking member 3125 includes a second locking block 31251 and a second pushing block 31252. The first sleeve 3122 is provided with a first channel 31222, and the second sleeve 3123 is provided with a second channel 31232. The first channel 31222 is in communication with the second channel 31232 to form a sliding channel 3126. The second locking block 31251 is slidably arranged in the sliding channel 3126. In addition, the second pushing block 31252 is connected to the second locking block 31251, so that the second pushing block 31252 is configured for pushing the second locking block 31251 to slide within the sliding channel 3126. When a locking end 31253 of the second locking block 31251 is positioned in the first channel 31222, the second locking member 3125 is in the locked state. When the locking end 31253 of the second locking block 31251 slides to a position distal from the first channel 31222, the second locking member 3125 is in the unlocked state. The first sleeve 3122 and the second sleeve 3123 are capable of rotating relative to each other, so that the telescoping sleeve 312 is capable of switching between the unfolded state and the folded state. A fourth mounting opening 31233 is defined in a side wall of the second sleeve 3123. The second pushing block 31252 is arranged in the fourth mounting opening 31233 and extends outwardly, and the second pushing block 31252 is movable within the fourth mounting opening 31233. Through the above structure, users can directly push the second pushing block 31252 to drive the second locking block 31251 to slide within the sliding channel 3126. In this way, this can enable the second locking member 3125 to achieve quick and accurate switching between the locked state and the unlocked state. In the locked state, the locking end 31253 of the second locking block 31251 is embedded in the first channel 31222 to form a stable limit, so as to ensure the structural stability of the telescoping sleeve 312 in the unfolded state. In the unlocked state, the locking end 31253 of the second locking block 31251 is configured for sliding away from the first channel 31222, so as to allow the first sleeve 3122 and the second sleeve 3123 to rotate relative to each other. Therefore, this enables the telescoping sleeve 312 to smoothly complete the transition between the folded state and the unfolded state, so as to improve the flexibility and user experience of the telescoping sleeve 312 in different usage scenarios.

Figure 15:
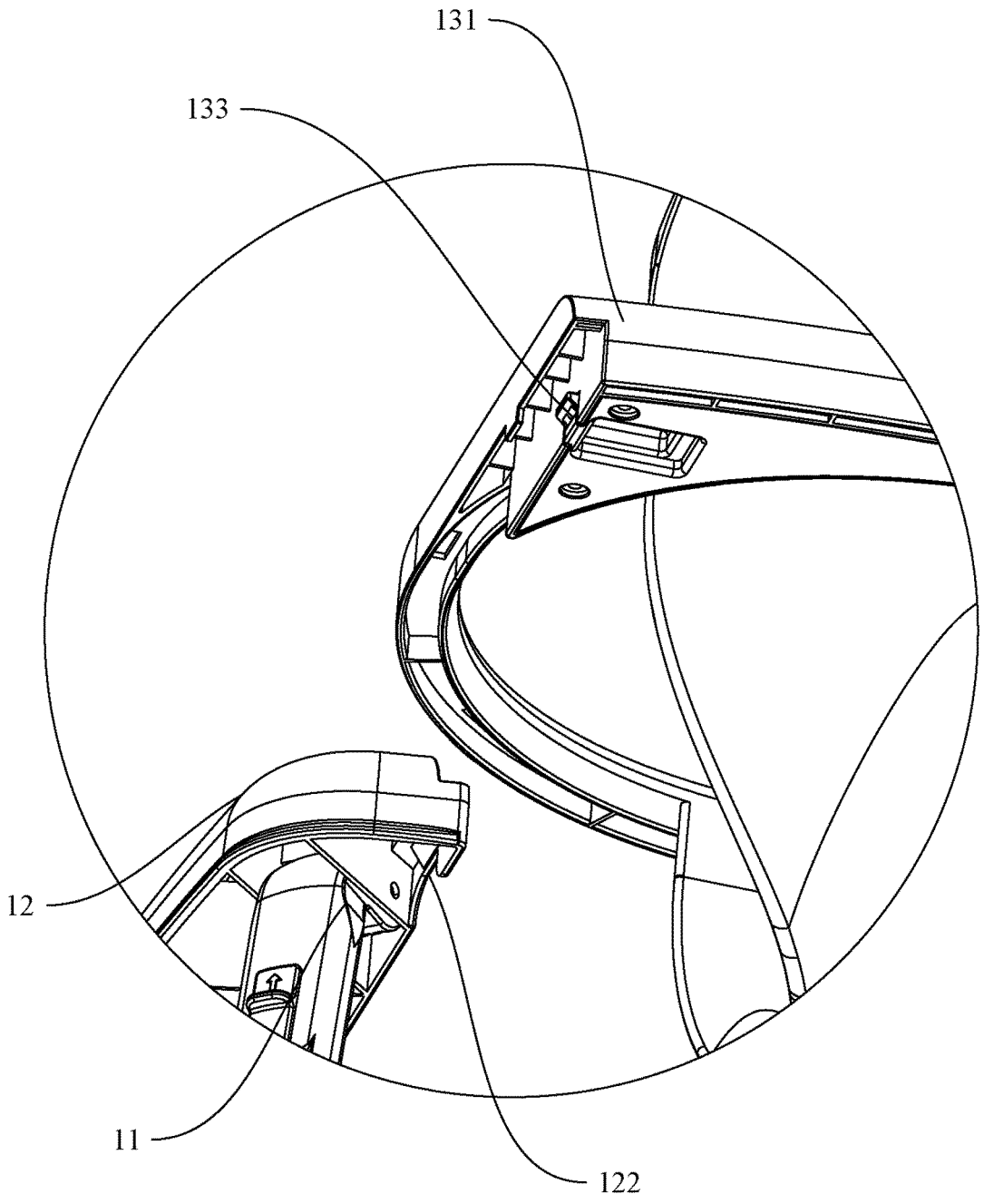
FIG. 15 is an exploded view showing the connection between a seat assembly and a support frame.
Figure 16:
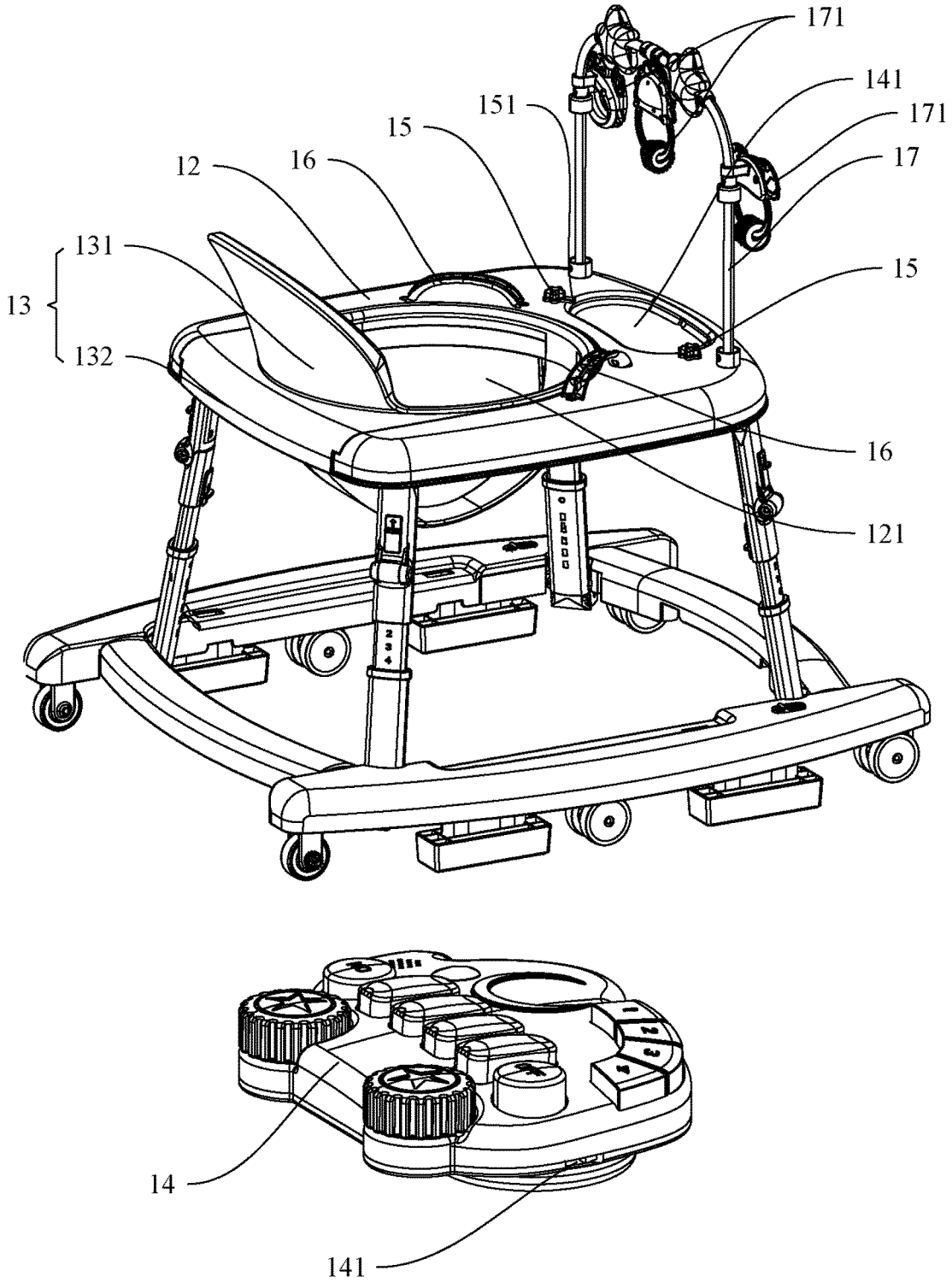
FIG. 16 is a structural diagram of an upper plate assembly.

In this embodiment, referring to FIG. 15 and FIG. 16, the upper plate assembly 1 includes a support frame 12 and a seat assembly 13 detachably connected to the support frame 12. A mounting cavity 121 is defined in the support frame 12. The seat assembly 13 is detachably mounted in the mounting cavity 121. The seat assembly 13 includes a seat bracket 131 and a seat 132 arranged on the seat bracket 131. Locking blocks 133 are respectively arranged on both ends of a rear side of the seat bracket 131. Locking slots 122 are respectively arranged on both ends of a rear side of the support frame 12. The locking blocks 133 are engaged in the locking slots 122, so that the seat assembly 13 is detachably connected to the support frame 12. Through the above structure, the seat assembly 13 has a stable connection in the mounting state, and the convenience of quick disassembly of the seat assembly 13 is enhanced. The second transverse bar 22 is detachably connected to the side support bar 23, so that the baby walker is enabled to flexibly switch between a walking aid mode and a stroller mode. When the seat assembly 13 and the second transverse bar 22 are in a connected state, the baby walker is in the walking aid mode. When the seat assembly 13 and the second transverse bar 22 are in a detached state, the baby walker is in the stroller mode. Therefore, this meets the needs of infants and toddlers at different growth stages, thereby achieving multi-functionality, operational convenience, and structural stability, while enhancing the user experience.

In this embodiment, the baby walker further includes a music box 14 and a knob 15. The music box 14 is detachably connected to the upper plate assembly 1. The knob 15 is rotatably connected on the upper plate assembly 1. A locking latch 151 is arranged on the knob 15. The upper plate assembly 1 is provided with a mounting slot 123 configured for mounting the music box 14. A slot 141 is defined in the music box 14. When the music box 14 is mounted in the mounting slot 123, the locking latch 151 enters the slot 141 in response to rotation of the knob 15. Therefore, the music box 14 is limited and locked in the mounting slot 123 configured for mounting the music box 14. Through the above structure, the music box 14 can be accurately positioned and mounted on the upper plate assembly 1. By arranging the knob 15, a stable and reliable connection can be established between the music box 14 and the upper plate assembly 1. By arranging the music box 14, the entertainment value and user engagement of the baby walker can be increased, and the user experience of the product is improved.

In this embodiment, the baby walker further includes handrails 16. The handrails 16 are arranged on the upper plate assembly 1 and are positioned at two sides of the seat assembly 13. By arranging the handrails 16, the safety of infants and toddlers is improved when using the baby walker.

In this embodiment, the baby walker further includes a decorative rack 17. The decorative rack 17 is detachably connected to a front side of the upper plate assembly 1. A plurality of decorative elements 171 are hung on the decorative rack 17. Through the above structure, entertainment value of the baby walker is significantly increased.

In this embodiment, the wheel assembly 24 includes front wheels 241, rear wheels 242, and intermediate wheels 243 positioned between the front wheels 242 and the rear wheels 243. A plurality of first mounting slots 234 are defined in a bottom portion of the side support bar 23. The front wheels 241, the rear wheels 242, and the intermediate wheels 243 are detachably mounted in the first mounting slots 234. The front wheels 241 and the intermediate wheels 243 are caster wheels (universal wheels). The rear wheels 242 are directional wheels. Preferably, the rear wheels 242 also can be caster wheels.

In this embodiment, the bottom portion of the side support bar 23 is further provided with at least one stabilizing member 235 configured for preventing the baby walker 100 from falling down. A second mounting slot 236 is defined in the bottom portion of the side support bar 23. The stabilizing member 235 is mounted in the second mounting slot 236.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

The invention claimed is:

1. A multifunctional baby walker, comprising:

an upper plate assembly, a base frame assembly, and a support assembly configured for connecting the upper plate assembly and the base frame assembly;

wherein the base frame assembly comprises a first transverse bar and a second transverse bar arranged opposite to the first transverse bar, a side support bar is arranged between the first transverse bar and the second transverse bar, an outer side wall of the side support bar is provided with an arc-shaped protruding surface, and a wheel assembly is arranged at a bottom portion of the side support bar;

the side support bar is provided with a first operational state and a second operational state, and the side support bar is capable of switching between the first operational state and the second operational state; when the side support bar switches to the first operational state, the protruding surface is disengaged from a ground, and the wheel assembly is configured for supporting the baby walker on the ground; when the side support bar switches to the second operational state, the protruding surface is in contact with the ground, and the wheel assembly is lifted away from the ground, so that the baby walker is capable of swinging back and forth;

wherein the side support bar comprises a first inner rod and a first outer bar mounted on the first inner rod, the protruding surface is arranged on an outer side wall of the first outer bar, the wheel assembly is arranged at a bottom portion of the first outer bar, and the first outer bar is capable of rotating around the first inner rod, so that the side support bar is capable of switching between the first operational state and the second operational state;

wherein the base frame assembly further comprises a first locking member arranged on the side support bar, and the first locking member is provided with a locked state and an unlocked state; when the first locking member is in the locked state, the first locking member is configured for locking the side support bar in either the first operational state or the second operational state; when the first locking member is in the unlocked state, the first locking member is released to disengage the lock on the side support bar, so that the side support bar is capable of switching between the first operational state and the second operational state;

wherein a first locking portion is arranged on the side support bar, the first locking member is slidably arranged on the side support bar, and the first locking member is provided with a first locking engagement portion corresponding to the first locking portion; when the first locking engagement portion is connected to the first locking portion, the first locking member is in the locked state, and the first locking member is configured for locking the side support bar in either the first operational state or the second operational state; when the first locking engagement portion is disconnected from the first locking portion, the first locking member is in the unlocked state, and the first outer bar is capable of rotating around the first inner rod, so that the first outer bar is capable of switching between the first operational state and the second operational state;

wherein the first locking member comprises a first locking block and a first pushing block connected to the first locking block, the first locking block is slidably arranged on the first inner rod, the first locking portion is arranged on the first inner rod, the first locking engagement portion is arranged on the first locking block, and the first pushing block is configured for pushing the first locking block to slide on the first inner rod, so that the first locking portion is connected to or disconnected from the first locking engagement portion.

2. The multifunctional baby walker according to claim 1, wherein the first locking block is provided with a sleeve portion, a receiving hole is defined in the sleeve portion, and the first inner rod is inserted into the receiving hole, so that the first locking block is slidably arranged on the first inner rod; a connecting slot is defined in the first locking block, the first pushing block comprises a pushing portion and a connecting post, and the connecting post is mounted inside the connecting slot, so that the first pushing block is connected to the first locking block.

3. The multifunctional baby walker according to claim 2, wherein a first mounting opening is defined in the first outer bar, the connecting post is inserted into the first mounting opening and extends inwards to connect to the connecting slot, the pushing portion is arranged facing an outer side of the first mounting opening, and a pushing protrusion and an anti-slip texture are arranged on a surface of the pushing portion.

4. The multifunctional baby walker according to claim 3, wherein a limiting block is arranged on the first inner rod, and the limiting block abuts against the first locking block, so as to limit a moving distance of the first locking block.

5. The multifunctional baby walker according to claim 1, wherein two side support bars are arranged between the first transverse bar and the second transverse bar, and the two side support bars are arranged opposite to each other; first ends of the two side support bars are connected to both ends of the first transverse bar via first connecting members, and second ends of the two side support bars are detachably connected to both ends of the second transverse bar via second connecting members.

6. The multifunctional baby walker according to claim 5, wherein the first connecting member comprises a first connecting block and a second connecting block connected to the first connecting block, the side support bar is connected to the first connecting block, and the first transverse bar is connected to the second connecting block, so that the side support bar is connected to the first transverse bar; a mounting recess is defined in the first connecting block, and the second connecting block is arranged in the mounting recess, so that the first connecting block is connected to the second connecting block.

7. The multifunctional baby walker according to claim 6, wherein a first mounting channel is arranged on the first connecting block, a second mounting channel is arranged on the second connecting block, the first transverse bar comprises a second inner rod and a second outer bar mounted on the second inner rod, the first inner rod of the side support bar is inserted into the first mounting channel, the second inner rod is inserted into the second mounting channel, the first outer bar of the side support bar is engaged with the first connecting block, and the second outer bar is engaged with the second connecting block, so that the side support bar is connected to the first transverse bar.

8. The multifunctional baby walker according to claim 7, wherein a plurality of first mounting notches are arranged on an inner side wall of the first outer bar of the side support bar, and the first inner rod is engaged in the first mounting notch, so that the first outer bar is connected to the first inner rod, and a plurality of second mounting notches are arranged on an inner side wall of the second outer bar; the second inner rod is engaged in the second mounting notch, so that the second outer bar is connected to the second inner rod, both end portions of the first outer bar are provided with first engagement interfaces, the first engagement interface is engaged with the first connecting block, both end portions of the second outer bar are provided with second engagement interfaces, and the second engagement interface is engaged with the second connecting block.

9. The multifunctional baby walker according to claim 8, wherein a third mounting channel is arranged on a first end of the second connecting member, a second end of the side support bar is inserted into the third mounting channel, a first engagement block is arranged on a side wall of a second end of the second connecting member, a first engagement slot is defined in the first engagement block, both end portions of the second transverse bar are respectively provided with third mounting notches, and the third mounting notch is engaged in the first engagement slot, so that the side support bar is detachably connected to the second transverse bar; both end portions of the second transverse bar are provided with second engagement blocks, a limiting protrusion is arranged at a bottom portion of a side wall of the second engagement block, a limiting plate is arranged on a side wall of the first engagement block, and the limiting protrusion abuts against the limiting plate, so that the second transverse bar and the side support bar are limited and mounted together.

10. The multifunctional baby walker according to claim 1, wherein a first end of the support assembly is connected to the upper plate assembly, a second end of the support assembly is connected to the base frame assembly, and a length of the support assembly is adjustable between a retracted state and an extended state, so as to adjust a distance between the upper plate assembly and the base frame assembly.

11. The multifunctional baby walker according to claim 10, wherein the support assembly comprises a telescoping assembly and a first linking rod, a first end of the telescoping assembly is connected to the upper plate assembly, a second end of the telescoping assembly is connected to a first end of the first linking rod, and a second end of the first linking rod is connected to the base frame assembly; a first connecting portion is arranged on the base frame assembly, a second connecting portion is arranged at a bottom portion of the upper plate assembly, a bottom end of the first linking rod is connected within the first connecting portion, and the first end of the telescoping assembly is connected within the second connecting portion.

12. The multifunctional baby walker according to claim 11, wherein the telescoping assembly comprises a telescoping rod, a telescoping sleeve, and a first locking spring clip, a first opening is defined in the telescoping sleeve, a first end of the telescoping rod is inserted into the telescoping sleeve via the first opening, a second opening is defined in the first linking rod, a second end of the telescoping rod is inserted into the first linking rod via the second opening, and the telescoping rod is slidable inside the first linking rod, so as to adjust the length of the support assembly;

a plurality of first adjusting holes are defined in a side wall of the first linking rod, the first locking spring clip is arranged on the telescoping rod, when the first locking spring clip slides along with the telescoping rod to the first adjusting hole, the first locking spring clip extends out from the first adjusting hole, and the first locking spring clip is configured for locking the telescoping rod on the telescoping sleeve, so as to fix the length of the support assembly;

the telescoping rod is further provided with an operation block configured for pulling the telescoping rod to slide within the first linking rod, a first mounting block is arranged inside a top end of the telescoping rod, a second mounting opening is defined in a side wall of a top end of the telescoping sleeve, a third mounting opening is defined in a side wall of the top end of the telescoping rod, the operation block is inserted into the third mounting opening and the second mounting opening in sequence, the operation block extends into an inner portion of the telescoping rod to connect to the first mounting block, and when the operation block is pushed, the first mounting block is driven to move by the operation block, so as to drive the telescoping rod to slide within the first linking rod;

a second mounting block is arranged inside a bottom end of the telescoping rod, a through hole is defined in the second mounting block, the first locking spring clip comprises a first latch and an elastic linking rod, the first latch is arranged in the through hole, and the first latch is connected to the first mounting block via the elastic linking rod; when the operation block is pushed to move, the first latch is configured for sliding along with the telescoping rod, and the first latch is configured for sliding inside the telescoping rod and pressing the elastic linking rod; when the first locking spring clip slides to the first adjusting hole, the elastic linking rod is configured for pushing the first latch to extend out from the first adjusting hole.

13. The multifunctional baby walker according to claim 12, wherein the telescoping sleeve comprises a first sleeve and a second sleeve, the first sleeve is connected to the telescoping rod, and the first sleeve is rotatably connected to the second sleeve, so that the telescoping sleeve is provided with a folded state and an unfolded state.

14. The multifunctional baby walker according to claim 13, wherein a first rotating portion is arranged on the first sleeve, a second rotating portion is arranged on the second sleeve, and the first rotating portion is rotatably connected to the second rotating portion via a rotating shaft;

the telescoping sleeve further comprises a second locking member arranged on the second sleeve, the second locking member is provided with a locked state and an unlocked state, when the second locking member is in the locked state, the second locking member is configured for locking the telescoping sleeve in the unfolded state; when the second locking member is in the unlocked state, the telescoping sleeve is capable of switching between the unfolded state and the folded state;

the second locking member comprises a second locking block and a second pushing block, the first sleeve is provided with a first channel, the second sleeve is provided with a second channel, the first channel is in communication with the second channel to form a sliding channel, the second locking block is slidably arranged in the sliding channel, and the second pushing block is connected to the second locking block, so that the second pushing block is configured for pushing the second locking block to slide within the sliding channel; when a locking end of the second locking block is positioned in the first channel, the second locking member is in the locked state, when the locking end of the second locking block slides to a position distal from the first channel, the second locking member is in the unlocked state, and the first sleeve and the second sleeve are capable of rotating relative to each other, so that the telescoping sleeve is capable of switching between the unfolded state and the folded state; a fourth mounting opening is defined in a side wall of the second sleeve, the second pushing block is arranged in the fourth mounting opening and extends outwardly, and the second pushing block is movable within the fourth mounting opening.

15. The multifunctional baby walker according to claim 1, wherein the wheel assembly comprises front wheels, rear wheels, and intermediate wheels positioned between the front wheels and the rear wheels, a plurality of first mounting slots are defined in a bottom portion of the side support bar, and the first mounting slots are configured for mounting the front wheels, the rear wheels, and the intermediate wheels; the bottom portion of the side support bar is further provided with at least one stabilizing member configured for preventing the baby walker from falling down.

16. A multifunctional baby walker, comprising:

an upper plate assembly, a base frame assembly, and a support assembly configured for connecting the upper plate assembly and the base frame assembly;

wherein the base frame assembly comprises a first transverse bar and a second transverse bar arranged opposite to the first transverse bar, a side support bar is arranged between the first transverse bar and the second transverse bar, an outer side wall of the side support bar is provided with an arc-shaped protruding surface, and a wheel assembly is arranged at a bottom portion of the side support bar;

the side support bar is provided with a first operational state and a second operational state, and the side support bar is capable of switching between the first operational state and the second operational state; when the side support bar switches to the first operational state, the protruding surface is disengaged from a ground, and the wheel assembly is configured for supporting the baby walker on the ground; when the side support bar switches to the second operational state, the protruding surface is in contact with the ground, and the wheel assembly is lifted away from the ground, so that the baby walker is capable of swinging back and forth;

wherein the upper plate assembly comprises a support frame and a seat assembly detachably connected to the support frame, a mounting cavity is defined in the support frame, the seat assembly is detachably mounted in the mounting cavity, the seat assembly comprises a seat bracket and a seat arranged on the seat bracket, locking blocks are respectively arranged on both ends of a rear side of the seat bracket, locking slots are respectively arranged on both ends of a rear side of the support frame, and the locking blocks are engaged in the locking slots, so that the seat assembly is detachably connected to the support frame;

the baby walker further comprises a music box and a knob, the music box is detachably connected to the upper plate assembly, the knob is rotatably connected on the upper plate assembly, a locking latch is arranged on the knob, the upper plate assembly is provided with a mounting slot configured for mounting the music box, and a slot is defined in the music box; when the music box is mounted in the mounting slot, the locking latch enters the slot in response to rotation of the knob, so that the music box is limited and locked in the mounting slot configured for mounting the music box;

the baby walker further comprises handrails, the handrails are arranged on the upper plate assembly and are positioned at two sides of the seat assembly;

the baby walker further comprises a decorative rack, the decorative rack is detachably connected to a front side of the upper plate assembly, and a plurality of decorative elements are hung on the decorative rack.

17. The multifunctional baby walker according to claim 16, wherein the side support bar comprises a first inner rod and a first outer bar mounted on the first inner rod, the protruding surface is arranged on an outer side wall of the first outer bar, the wheel assembly is arranged at a bottom portion of the first outer bar, and the first outer bar is capable of rotating around the first inner rod, so that the side support bar is capable of switching between the first operational state and the second operational state.

18. The multifunctional baby walker according to claim 17, wherein the base frame assembly further comprises a first locking member arranged on the side support bar, and the first locking member is provided with a locked state and an unlocked state; when the first locking member is in the locked state, the first locking member is configured for locking the side support bar in either the first operational state or the second operational state; when the first locking member is in the unlocked state, the first locking member is released to disengage the lock on the side support bar, so that the side support bar is capable of switching between the first operational state and the second operational state.

19. The multifunctional baby walker according to claim 16, wherein two side support bars are arranged between the first transverse bar and the second transverse bar, and the two side support bars are arranged opposite to each other; first ends of the two side support bars are connected to both ends of the first transverse bar via first connecting members, and second ends of the two side support bars are detachably connected to both ends of the second transverse bar via second connecting members.

20. The multifunctional baby walker according to claim 16, wherein a first end of the support assembly is connected to the upper plate assembly, a second end of the support assembly is connected to the base frame assembly, and a length of the support assembly is adjustable between a retracted state and an extended state, so as to adjust a distance between the upper plate assembly and the base frame assembly.

* * * * *